United States Patent [19]

Kim et al.

[11] Patent Number: 4,847,046

[45] Date of Patent: Jul. 11, 1989

[54] ULTRA-LOW TEMPERATURE ALLOY AND PROCESS FOR MANUFACTURING THE SAME

[75] Inventors: Young-Gil Kim; Jae-Kwang Han, both of Seoul, Rep. of Korea

[73] Assignee: Korea Advanced Institute of Science and Technology, Seoul, Rep. of Korea

[21] Appl. No.: 902,563

[22] Filed: Sep. 2, 1986

[30] Foreign Application Priority Data

Aug. 31, 1985 [KR] Rep. of Korea ..... 6356/85

[51] Int. Cl.[4] ..... C22C 38/04

[52] U.S. Cl. ..... 420/76; 420/72; 148/329; 148/12.1; 72/700; 29/527.7

[58] Field of Search ..... 420/76, 72, 582; 148/329, 12 R, 12.1; 29/527.7; 72/700

[56] References Cited

U.S. PATENT DOCUMENTS 3,193,884 7/1965 Richardson ..... 148/329

FOREIGN PATENT DOCUMENTS 234177 12/1959 Austria ..... 420/72
5236513 3/1977 Japan ..... 420/72
60-63317 4/1985 Japan ..... 148/12 R
605440 7/1948 United Kingdom ..... 420/76

OTHER PUBLICATIONS

J. Charles, "New Cryogenic Materials:Fe-Mn-Al Alloys", Metals Progress, May 1981, pp. 71-74.

*Primary Examiner*—Deborah Yee
*Attorney, Agent, or Firm*—Antonelli, Terry & Wands

[57] ABSTRACT

A new Fe-Mn-Al-C-Nb-Si-Cu alloy for use in ultra-low temperature materials is provided. The alloy has the following composition: 25 to 35 percent by weight manganese, 2 to 10 percent by weight aluminum, 0.1 to 0.8 percent by weight carbon, 0.01 to 0.2 percent by weight niobium, 0.05 to 0.5 percent by weight silicon, 0.05 to 1.0 percent by weight copper and the balance of iron. The alloy is manufactured by controlled rolling the ingot containing the elemental constituents, and has a tensile strength of above 350 MPa, an elongation of 40%, and a toughness of above 100 joules at −196° C.

14 Claims, 6 Drawing Sheets

ULTRA-LOW TEMPERATURE ALLOY AND PROCESS FOR MANUFACTURING THE SAME

BACKGROUND OF THE INVENTION

1. Field of the Invention

The present invention relates to an ultra-low temperature alloy, and more particularly to a new Fe—Mn—Al—C—Nb—Si—Cu alloy which can be made by adding Nb, Si and Cu as minor alloying elements to a conventional Fe—Mn—Al—C alloy steel. The present invention also relates to an ultra-low temperature alloy, provided by controlled rolling the alloy. The invention further relates to a process of forming the alloy, including a controlled rolling of the alloy. The alloy in accordance with the invention has greater impact toughness and strength than a standard ASTM A553 9% nickel steel for use in ultra-low temperature materials.

Presently, the demands for materials for liquefied natural gas (LNG) storage tanks are increasing because of the economics thereof. Consequently, demands for the aforementioned 9% nickel steel, which has high strength and toughness even at −196° C. have increased considerably. However, this conventional alloy steel contains a large amount of nickel, which is an expensive strategic material; therefore, the price of the steel fluctuates very widely in the market. In addition, since the 9% nickel steel has a body centered cubic lattice structure, its mechanical properties tend to degrade rapidly at about −190° C.

2. Description of the Prior Art

Toughness is an important factor desired in low temperature materials. In order to improve the toughness at low temperatures, it has been recommended that a steel be stabilized to have an austenitic structure with face-centered cubic lattices without a ductile-brittle transition temperature. The Fe—Mn—Al—C alloy mentioned above was developed for this purpose, J. Charles, et al., Met. Prog. 119, 71 (1981). The Fe—Mn—Al—C alloy with an austenitic structure is superior in toughness but inferior in strength to the 9% nickel alloy steel.

SUMMARY OF THE INVENTION

It is therefore an object of the invention to provide a new alloy that like the 9% nickel alloy steel has greater strength and corrosion resistance than the Fe—Mn—Al—C steel but which has greater low temperature toughness than the 9% nickel steel.

Another object of the invention is to provide a process for manufacturing such an alloy.

These and other objects of the invention can be attained by the Fe—Mn—Al—C—Nb—Si—Cu alloy of the present invention, which comprises 25 to 35 percent by weight manganese, 2 to 10 percent by weight aluminum, 0.1 to 0.8 percent by weight carbon, 0.01 to 0.2 percent by weight niobium, 0.05 to 0.5 percent by weight silicon, 0.05 to 1.0 percent by weight copper and the balance of which is iron.

If the amount of manganese added is less than 25 percent, it is not possible to obtain an alloy having the austenitic structure. The presence of this element in an amount greater than 35 percent results in a decrease in the low-temperature rupture toughness of the alloy. When the concentration of aluminum is less than 2 percent, no inverse ductility results in the alloy and the low-temperature rupture toughness of the alloy is decreased. An aluminum concentration above 10 percent results in formation of undesirable phases. Whenever carbon, as a reinforcing element, is present in an amount less than 0.05 percent or above 0.5 percent, the rupture toughness of the alloy is decreased. Niobium, as a precipitation hardening element, is expensive and, therefore, it is recommended that the element be added at a minimum level, preferably about 0.1 percent. Silicon is also a reinforcing element, and may reduce the rupture toughness of the alloy when used in an amount greater than 0.5 percent. Copper increases the corrosion resistance of the alloy in the atmosphere, but degrades the mechanical properties of the alloy when it is used in the amount of 0.1 percent or more.

The objects of the present invention are further attained by a method of processing such alloy, wherein the alloy is not subjected to cold rolling but rather is subjected to a controlled hot rolling, including an ultimate (final) hot rolling at a temperature within the range of 600°-850° C., with 10-40% ultimate reduction (that is, reduction in thickness of the rolled sheet) after prior (intermediate) rolling, if any. By this ultimate hot rolling, where the alloy is subjected to such final thickness reduction at the specified ratio, the rolling being performed in the specified temperature range, a very fine grain size (e.g., as compared with such alloy not subjected to the ultimate hot rolling) is achieved in the finally rolled plates.

BRIEF DESCRIPTION OF THE DRAWINGS

The present invention will be understood more fully from the detailed description given hereinbelow and the accompanying drawings of the preferred embodiments of the invention.

DETAILED DESCRIPTION OF THE INVENTION

In accordance with the invention, both the poor elongation (20%) of the 9% nickel alloy steel and the poor strength (300 MPa) of the Fe—Mn—Al—C alloy have been improved. A new alloy is thus provided which has toughness like those of prior art materials.

In the present invention, it is a goal to obtain an alloy having toughness at least equal to that of Fe—Mn—Al—C, and strength and the corrosion resistance approximately equal to those of the 9% nickel steel. For the purposes, a composition of the elemental constituents shown in Table 1 below was prepared. This composition is then subjected to treatment to impart the desired high strength and toughness, respectively. Among the constituents shown in Table 1, manganese, aluminum and carbon are used as major constituents for obtaining an austenitic structure in the alloy steel designed in accordance with the invention. Inhibition of the growth of grains and strength of the solid solution of the steel are achieved by adding 0.1 percent niobium. Silicon is added in the amount of 0.2 percent which is more than that inevitably found during the mass production. The effects of the presence of silicon and copper to the strength and corrosion resistance of the steel were investigated.

TABLE 1

Compositions of Prior Art Alloy and the Invention

| Alloy | Composition (%) | | | | | | |
|---|---|---|---|---|---|---|---|
| | Mn | Al | C | Nb | Si | Cu | Fe |
| Prior Art | 30.0 | 5.0 | 0.3 | — | — | — | Balance |
| Invention | 30.0 | 5.0 | 0.3 | 0.1 | 0.2 | 0.3 | Balance |

Further, in order to achieve high strength by optimizing the effect of the added niobium and silicon, the composition is not subjected to cold rolling and recrystallization, but is subjected to controlled hot rolling. The term "controlled rolling" used herein means a method for obtaining the desired strength and toughness by optimally controlling the entire rolling step up to and including the ultimate stage from the initial heating stage prior to rolling. A good review of "controlled rolling" is found in T. Tanaka, "Controlled Rolling of Steel Plate and Strip", published by *International Metals Review*, 1981, No. 4, pages 185-212. When the controlled rolling is carried out after the addition of the trace elements, finer grains are formed. Formation of such finer grains increases the strength of the steel. An example of the controlled rolling in the present invention is diagrammatically illustrated in FIG. 1. In this drawing, preferably an intermediate rolling is performed at a temperature of 900° C., the intermediate reduction percentage being 25%; the ultimate rolling tempeature is preferably 600°-850° C., and the ultimate reduction percentage 10-40%.

Figure 1:
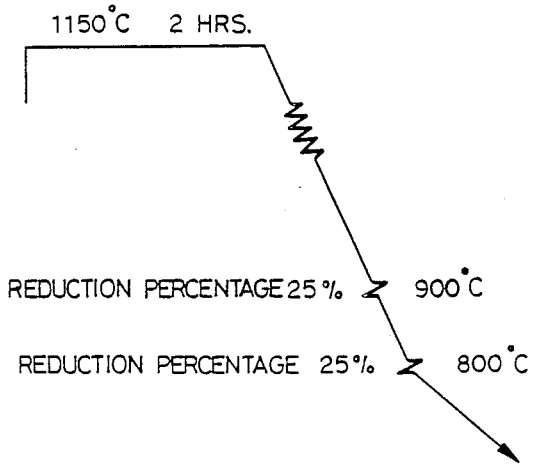
FIG. 1 is a diagrammatic flow chart of the controlled rolling in accordance with the invention.

As seen in FIG. 1, a controlled rolling of the specific alloy within the scope of the present invention includes an initial heating stage, an intermediate rolling and an ultimate rolling. As can be appreciated, however, the specific controlled rolling as shown in FIG. 1 is only exemplary to achieve the benefits of the present invention.

Thus, the initial heating stage in the controlled rolling process comprises steps of a homogenizing heat treatment to decrease the segregation tendency of the alloying elements and of providing the alloy with hot rollability during the controlled rolling. As a specific example, the homogenization can be conducted at 1150° C. for two hours in air. More generally, this initial heat treatment can be performed, e.g., at a temperature in the range of 1050°-1250° C. for 2-8 hours, depending on the grain size.

The intermediate rolling is shown in FIG. 1 as being performed at 900° C., with a reduction percentage (reduction in thickness of the sheet) of 25%. More generally, such intermediate rolling can be performed in air at a temperature of 850°-950° C., with a reduction percentage of 10-40%, depending on the number of passes and the temperature. The intermediate rolling starts with the initial heating temperature (e.g., the temperature at the initial heating stage, 1150° C.), until the temperature falls to 900° C.

The specific functions of the intermediate rolling are to reduce the original thickness and to homogenize the structure by grain size refinement and diffusion processes; the main purpose is for reducing the thickness of the original alloy as employed in the conventional hot rolling of steel plates. While this rolling is not critical, the total reduction percentage from the original plate, during the intermediate rolling (e.g., prior to the ultimate rolling) can be about 90%. The intermediate rolling is performed in multiple passes, the number thereof depending upon the original plate thickness.

There need be no holding (residence) time at, e.g., 900° C. during the intermediate rolling. But, the temperature before the final rolling should be in the range of 600°-850° C. Thus, a certain cooling time is necessary between the intermediate rolling and the ultimate rolling to obtain a temperature of 600°-850° C.

The ultimate controlled rolling temperature preferably ranges from 600° to 850° C. When the temperature is higher than 850° C., large, coarse grains grow rapidly. At a temperature lower than 600° C., it is difficult to roll the alloy composition as was done in the cold rolling. If the reduction percentage decreases below 10%, no refinement of the grains occurs, but if above 40%, cracks may be caused during the controlled rolling. The ultimate controlled rolling is performed, e.g., in a single pass, and is performed in air.

The controlled rolling of the alloy composition in accordance with the invention also increases the dislocation density of the alloy, together with the refinement of the grain sizes. This results in an increase in the yield and the tensile strength of the alloy by about 40%. Hot rolling without the controlled rolling decreases the dislocation density and, therefore, the yield and the tensile strength do not reach to that of the 9% Ni steel.

The processing steps after the controlled rolling are conventionally known in the art of forming controlled rolled products.

DESCRIPTION OF THE PREFERRED EMBODIMENTS

The invention will below be described in greater detail by way of the following examples without limitation of the invention thereto. All percentages in the examples are given by weight.

EXAMPLE 1

Alloying was conducted in the atmosphere using an induction furnace. Electrolytic iron, manganese, aluminum and copper, with a purity of above 99%, were used. As a source of niobium, a master alloy of Fe-Nb containing 66% Nb was used. Carbon and silicon with a purity of more than 98% were added. The composition of the alloy is shown in Table 2 below.

The electrolytic iron was first charged into the induction furnace. After the melting of the iron was complete, carbon and manganese were subsequently charged into the same furnace. A small amount of niobium, silicon and copper was added together with aluminum just before tapping. Analytical data are reported in Table 2 below.

TABLE 2

| Compositions of the Alloy of the Invention | | | | | | | |
|---|---|---|---|---|---|---|---|
| | Composition (%) | | | | | | |
| Alloy | Mn | Al | C | Nb | Si | Cu | Fe |
| Example 1 | 29.8 | 4.9 | 0.29 | 0.11 | 0.18 | 0.32 | Balance |

Upon completion of the melting operation, the resulting alloy was forged to control its size before homogenizing and rolling it. After the alloy was homogenized (at 1150° C. for 2 hours), it was subject to the intermediate and then ultimate rolling. The rolling operation was a controlled rolling according to the steps shown in FIG. 1. The rolled alloy was processed for subsequent testing. The controlled rolling produced a sheet of from 0.2 to 5 cm in thickness and of up to 100 cm in width. The size of the grain from the controlled rolling was the same as provided in ASTM grain size #11.

Figure 2:
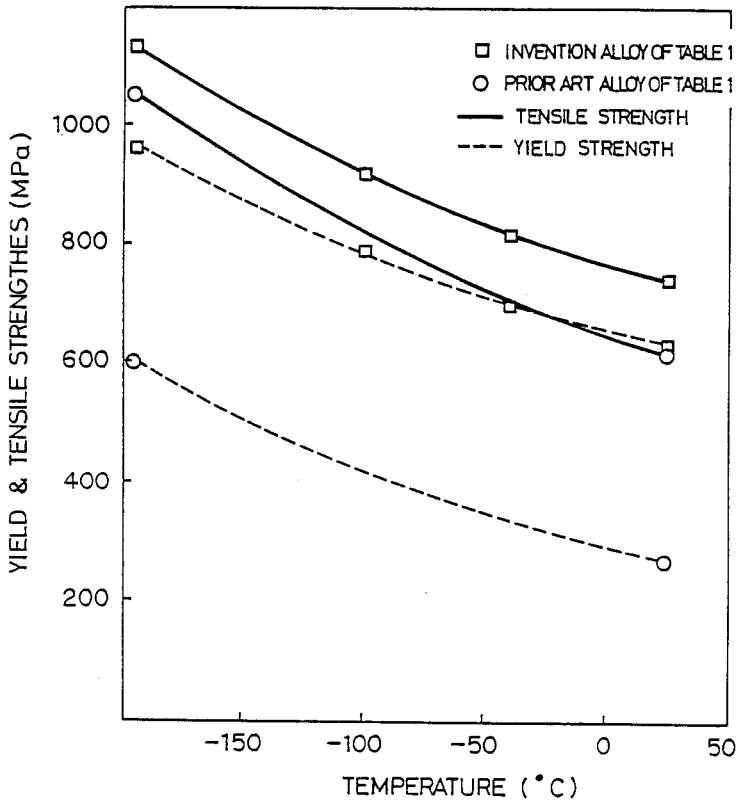
FIG. 2 is a comparative graph of the steels with and without having been subjected to controlled rolling.

Results of the tension testing on the sample alloy are reported in FIG. 2. This graph shows that the alloy which was subjected to controlled rolling in accordance with the invention has higher yield strength of above 300 MPa at room temperature as well as at −196° C. as compared with the prior art alloy in Table 1 above, which prior art alloy does not contain the minor elements and has not been subjected to controlled rolling.

Figure 3:
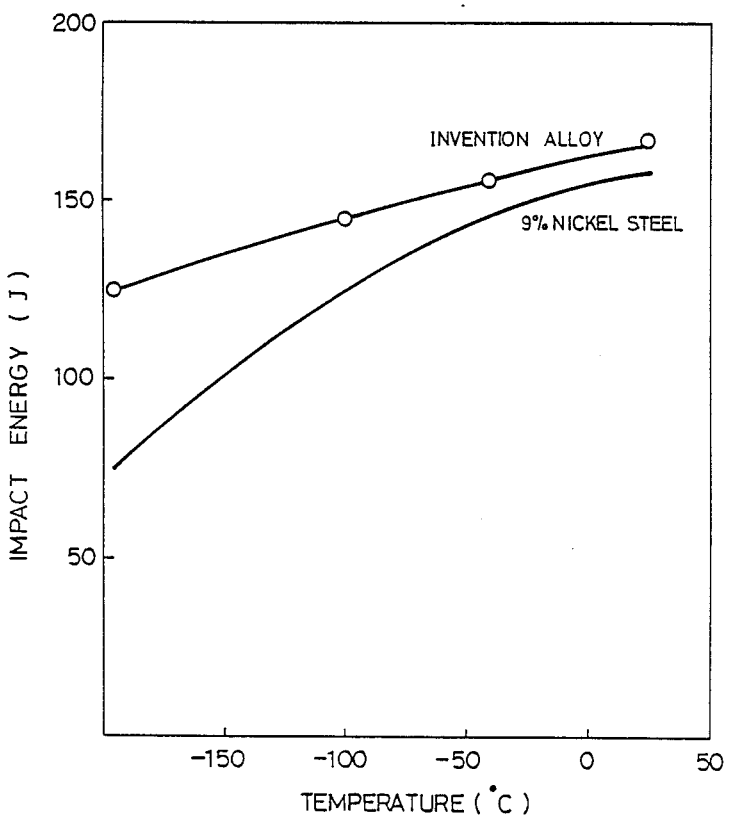
FIG. 3 is a comparative impact energy/temperature graph of a 9% nickel steel and the alloy in accordance with the invention.

FIG. 3 represents the results of the impact testing on the sample alloy of the invention and on 9% nickel alloy steel, and shows that the alloy of the invention has superior impact toughness over the entire temperature range than the 9% nickel alloy steel. Particularly, it can be noted that the difference of the toughness at −196° C., which is the lowest testing temperature, is about 50 joules or more.

The sample for the tension testing was a sheet having a size of 6×3×30 mm at the gauge part, and that for the impact testing had a size of 10×10×55 mm as specified in the ASTM E23.

Figure 4:
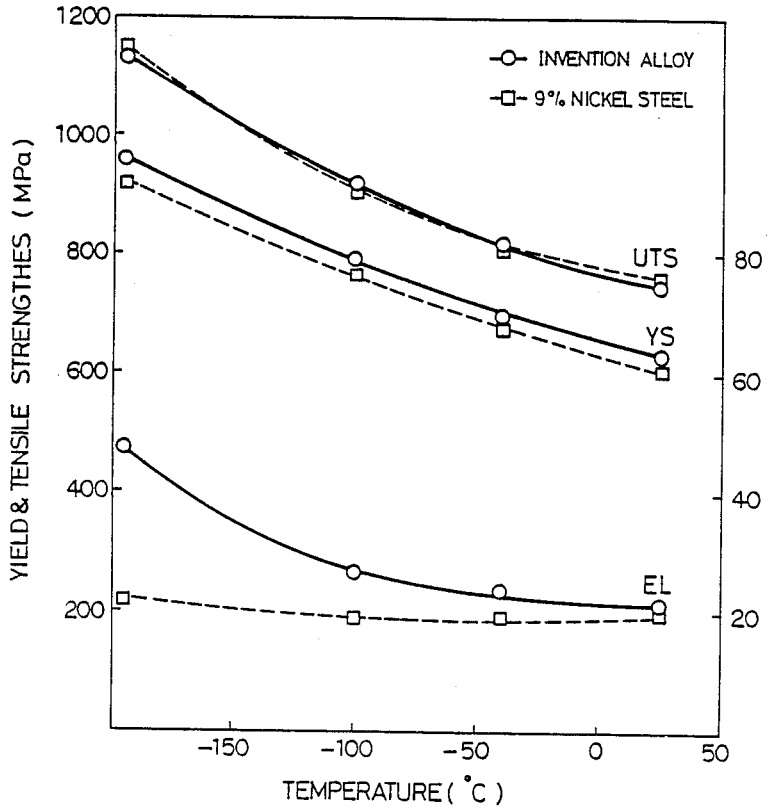
FIG. 4 is a comparative tensile elongation/temperature graph of a 9% nickel steel and the alloy in accordance with the invention.

FIG. 4 shows the tensile properties with the change of temperature of the 9% nickel steel and the sample alloy of the invention. From this graph it can be seen that the strength of the alloy was equal to that of the 9% nickel alloy steel. The sample alloy appeared to have a 47% elongation at −196° C., which was higher than the 21% elongation of the 9% nickel alloy steel at the same temperature. A noticeable phenomenon was that the ductility of the alloy was higher at lower temperatures. Such a phenomenon has not been observed in known steel materials, particularly in the 9% nickel alloy steel. This increase of ductility at lower temperatures is a very beneficial and desirable phenomenon in ultra-low temperature materials. It is believed that the reason for the increase in the ductility of the alloy of the invention is due to a strain-induced phase of mechanical twinning and, thus, necking thereof is inhibited, resulting in homogeneous deformation.

Figure 5:
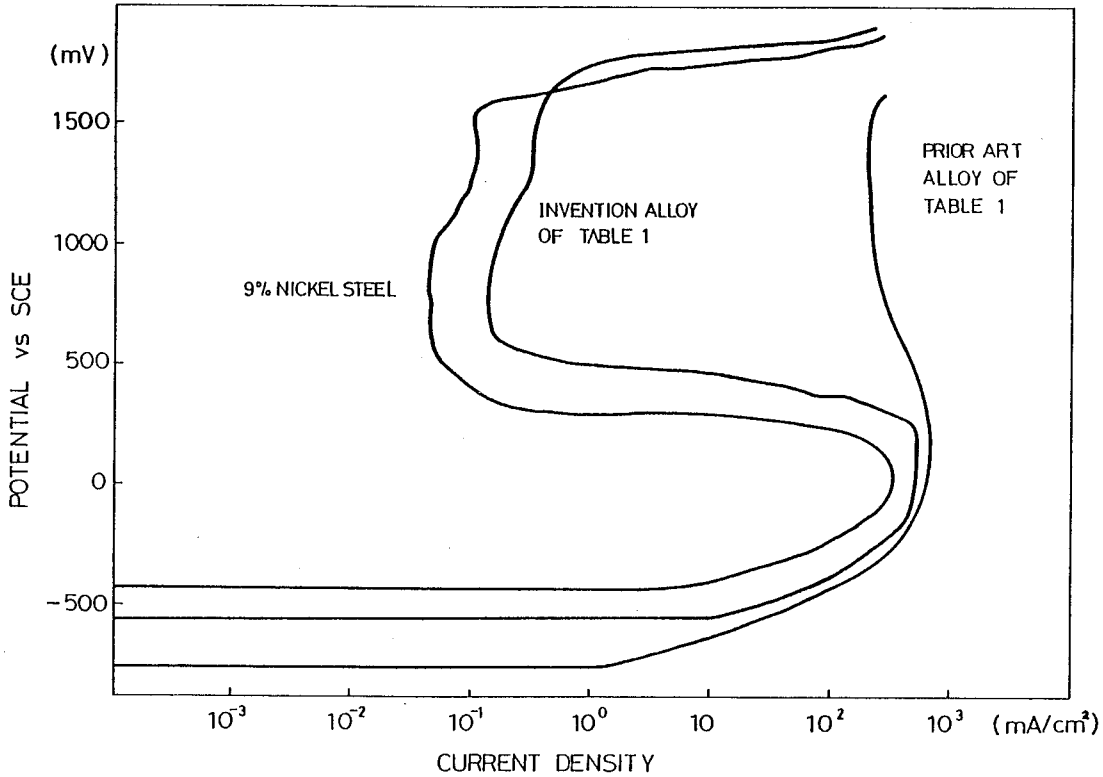
FIG. 5 is a graph showing the results of the corrosion testing of the prior art alloys and the alloy in accordance with the invention.

FIG. 5 shows the results of the corrosion testing with respect to the prior art alloys and the alloy in accordance with the invention. From this graph, it can be noted that the addition of copper results in passivation in the latter alloy. The addition of copper also improved the corrosion resistance and, thus, the alloy of the invention had passivation similar to the 9% nickel alloy steel. The prior art alloy made without copper was not passivated. For the corrosion testing, the copper content was fixed at 0.3%. At that time, the corrosion resistance attributed to the addition of copper increased equally to that in a weathering high strength-low alloy steel. It was found that the silicon added to the alloy of the invention in the amount of 0.18% had little effect on the mechanical properties of the alloy, but had a slight effect on the corrosion resistance and the refinement of the grains of the alloy. The solution used in the corrosion testing was a mixture of a 1N—$H_2SO_4$ and a 0.5% NaCl solution. The degree of corrosion was tested by a scanning potentiometer.

EXAMPLE 2

An alloy obtained by melting, rolling and forging in accordance with the same procedure as described in Example 1 gave the following composition as set forth in Table 3.

TABLE 3

| Composition of the Alloy of Example 2 (%) | | | | | | | |
|---|---|---|---|---|---|---|---|
| Composition | Mn | Al | C | Nb | Si | Cu | Fe |
| Intended | 33.0 | 7.5 | 0.3 | 0.15 | 0.3 | 0.6 | Balance |
| Determined | 32.7 | 7.7 | 0.27 | 0.15 | 0.27 | 0.56 | Balance |

This alloy was also refined by controlled rolling. From the value of the tensile strength tested, it was found that the strength was considerably increased to above 350 MPa by the effect of copper, niobium and silicon, as compared with that of the prior art alloy in Table 1. Ductility was slightly degraded due to the increase of strength, but elongation at −196° C. was 40%, which is higher than that of the 9% nickel alloy steel (21%).

EXAMPLE 3

In the intended composition, the amounts of manganese (as austenitic stabilizer) and aluminum (as a ferritic stabilizer) to be added have each been reduced.

The amount of the minor elements added, which was increased in Example 2, was also reduced. The alloy so prepared was subjected to a tension test. The intended and the determined compositions are set forth in Table 4 below.

TABLE 4

| Composition of the Alloy of Example 4 (%) | | | | | | | |
|---|---|---|---|---|---|---|---|
| Composition | Mn | Al | C | Nb | Si | Cu | Fe |
| Intended | 27.0 | 4.0 | 0.4 | 0.05 | 0.1 | 0.2 | Balance |
| Determined | 27.2 | 3.8 | 0.36 | 0.05 | 0.09 | 0.21 | Balance |

A sample alloy was made in accordance with Example 1. As a result of tension testing, it was found that the strength of the alloy was slightly decreased due to the reduction of the amounts of the aluminum and the minor elements, but the alloy has the same tendency with change of temperature as that of the alloy of the invention as described in Example 1. The alloy had higher strength than the prior art alloy of Example 1, higher tensile strength than the 9% nickel steel, and superior impact toughness to the alloy of Example 2.

EXAMPLE 4

It was found that the amount of aluminum used plays an important role in the increased ductility at a lower temperature in the alloy. The effect of varying the aluminum content (from 0 to 5%) in Fe—30Mn—Al—0.3C—0.1Nb—0.2Cu—0.1Si on tensile ductility is shown in FIG. 6.

The varied compositional alloys were also prepared by controlled hot rolling after hot forging of the cast ingot.

Figure 6:
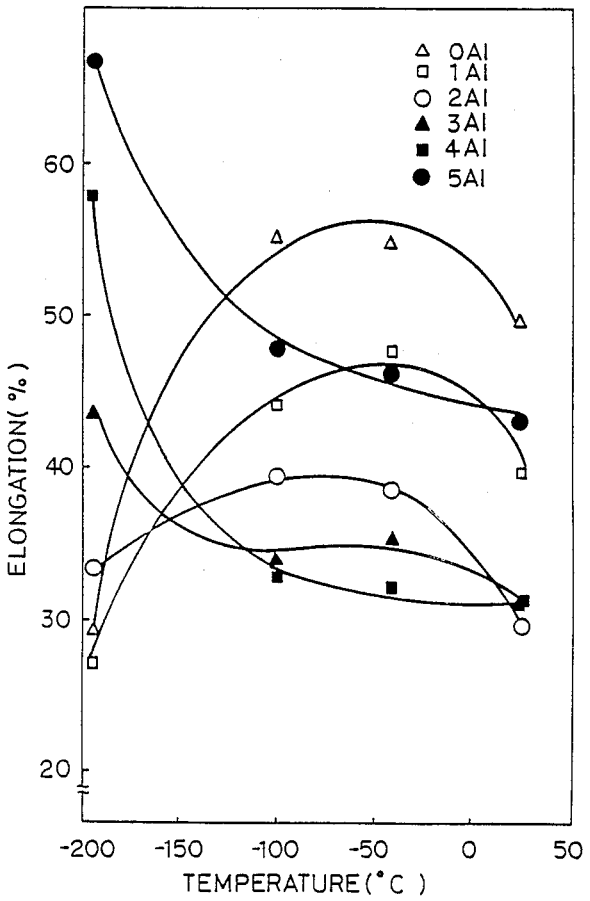
FIG. 6 is a graph showing the effect of varying the aluminum content from 0 to 5 weight percent on tensile elongation with temperature in the Fe—30Mn—Al—0.3C—0.1Si—0.2Cu alloy.

When the aluminum content was less than two weight percent, the reversed ductility with decreased temperature did not occur in the alloy as seen in FIG. 6. It is critical to have more than two weight percent aluminum for good ductility at a ultra-low temperature.

While we have shown and described several embodiments in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

What is claimed is:

1. An alloy comprising: 25 to 35 percent by weight manganese, 3 to 5 percent by weight aluminum, 0.1 to 0.8 percent by weight carbon, 0.01 to 0.2 percent by weight niobium, 0.05 to 0.5 percent by weight silicon, 0.05 to 1.0 percent by weight copper and the balance of iron, the alloy having a ductility that increases, as the temperature decreases, in the ultra-low temperature range, such that the alloy can be used as ultra-low temperature materials having strength and toughness.

2. A process for providing an alloy, comprising the step of subjecting said alloy to a controlled hot rolling so as to refine the grains of the alloy and provide fine grain size in the finally rolled alloy, said alloy comprising: 25 to 35 percent by weight manganese, 3 to 5 percent by weight aluminum, 0.1 to 0.8 percent by weight carbon, 0.01 to 0.2 percent by weight niobium, 0.05 to 0.5 percent by weight silicon, 0.05 to 1.0 percent by weight copper and the balance of iron, whereby the alloy can be used as an ultra-low temperature material having strength and toughness.

3. The alloy of claim 1, wherein the alloy has an austenitic structure.

4. The alloy of claim 1, consisting essentially of 25 to 35 percent by weight manganese, 3 to 5 percent by weight aluminum, 0.1 to 0.8 percent by weight carbon, 0.01 to 0.2 percent by weight niobium, 0.05 to 0.5percent by weight silicon, 0.05 to 1.0 percent by weight copper and the balance of iron.

5. The alloy of claim 1, consisting of 25 to 35 percent by weight manganese, 3 to 5 percent by weight aluminum, 0.1 to 0.8 percent by weight carbon, 0.01 to 0.2 percent by weight niobium, 0.05 to 0.5 percent by weight silicon, 0.05 to 1.0 percent by weight copper and the balance of iron.

6. The alloy of claim 1, having been subjected to a controlled hot rolling so as to refine the grains of the alloy and provide fine grain size in the finally rolled alloy.

7. The alloy of claim 6, wherein said fine grains have a size of ASTM #11.

8. The alloy of claim 6, said controlled hot rolling to which the alloy has been subjected including, as a final rolling step, an ultimate rolling at an ultimate rolling temperature of 600°–850° C., with a reduction percentage during the ultimate rolling of 10–40%.

9. The alloy of claim 1, wherein the amount of aluminum in the alloy is 3.8–4.9 percent by weight.

10. The process of claim 2, wherein the amount of aluminum in the alloy is 3.8–4.9 percent by weight.

11. A process for providing an alloy, comprising the step of subjecting said alloy to a controlled hot rolling so as to refine the grains of the alloy and provide fine grain size in the finally rolled alloy, said alloy comprising: 25 to 35 percent by weight manganese, 2 to 10 percent by weight aluminum, 0.1 to 0.8 percent by weight carbon, 0.01 to 0.2 percent by weight niobium, 0.05 to 0.5 percent by weight silicon, 0.05 to 1.0 percent by weight copper and the balance of iron, the controlled hot rolling including, as a final rolling step, an ultimate rolling at an ultimate rolling temperature of 600°–850° C., and a reduction percentage, during the ultimate rolling, of 10–40%, whereby the alloy can be used as an ultra-low temperature material having strength and toughness.

12. The process of claim 11, wherein said controlled hot rolling further includes, prior to said ultimate rolling, an intermediate rolling step at a temperature in a range of 850°–950° C.

13. The process of claim 12, wherein said controlled hot rolling further includes, prior to said intermediate rolling, a homogenizing heat treatment.

14. The process of claim 11, wherein the amount of aluminum in the alloy is 3–5 percent by weight.

* * * * *